US009539844B2

(12) United States Patent
Ioannou

(10) Patent No.: US 9,539,844 B2
(45) Date of Patent: Jan. 10, 2017

(54) METHOD OF REFURBISHING ROTOGRAVURE CYLINDERS, ROTOGRAVURE CYLINDERS AND THEIR USE

(71) Applicant: PARAMOUNT INTERNATIONAL SERVICES LTD., Majuro (MH)

(72) Inventor: Ioannis Ioannou, Rodopoli Attikis (GR)

(73) Assignee: Paramount International Services Ltd, Majuro (MH)

( * ) Notice: Subject to any disclaimer, the term of this patent is extended or adjusted under 35 U.S.C. 154(b) by 0 days.

(21) Appl. No.: 14/759,318

(22) PCT Filed: Jan. 8, 2013

(86) PCT No.: PCT/EP2013/050228

§ 371 (c)(1),
(2) Date: Jul. 6, 2015

(87) PCT Pub. No.: WO2014/108172

PCT Pub. Date: Jul. 17, 2014

(65) Prior Publication Data

US 2015/0336414 A1 Nov. 26, 2015

(51) Int. Cl.

| | |
|---|---|
| ***B41N 1/06*** | (2006.01) |
| ***B41N 1/20*** | (2006.01) |
| ***B41N 3/04*** | (2006.01) |
| ***B41N 3/00*** | (2006.01) |

(52) U.S. Cl.

CPC ..... *B41N 1/20* (2013.01); *B41N 3/003* (2013.01); *B41N 3/04* (2013.01); *B41N 1/06* (2013.01)

(58) Field of Classification Search

CPC ..... B41N 1/06; B41N 1/20; B41N 3/04; B41N 3/003

See application file for complete search history.

(56) References Cited

U.S. PATENT DOCUMENTS

| | | | | |
|---|---|---|---|---|
| 2,117,722 | A | 5/1938 | Huggins | |
| 4,119,035 | A * | 10/1978 | Reiser | B41N 1/10 101/401.1 |
| 8,443,516 | B2 * | 5/2013 | Bhullar | B41C 1/18 29/895.1 |
| 8,991,050 | B2 * | 3/2015 | Ioannou | B41N 1/20 205/296 |
| 2011/0083570 | A1 | 4/2011 | Bhullar et al. | |
| 2012/0240400 | A1 * | 9/2012 | Ioannou | B41N 1/20 29/890.1 |
| 2015/0197080 | A1 * | 7/2015 | Ioannou | B41N 1/20 101/375 |
| 2015/0259817 | A1 * | 9/2015 | Ioannou | B41C 1/18 205/151 |

FOREIGN PATENT DOCUMENTS

| | | | | |
|---|---|---|---|---|
| FR | 886 580 | 10/1943 | | |
| WO | WO 2011073695 A3 * | 1/2013 | | B41N 1/20 |

OTHER PUBLICATIONS

Notification of Transmittal of the International Search Report and the Written Opinion of the International Searching Authority, dated Sep. 13, 2013.

* cited by examiner

*Primary Examiner* — Daniel J Colilla
*Assistant Examiner* — Leo T Hinze
(74) *Attorney, Agent, or Firm* — Cook Alex Ltd.

(57) ABSTRACT

The rotogravure cylinder comprising a rotary gravure base and thereon a copper engraving layer is refurbished to contain a zinc layer between a gravure base and a layer package suitable for engraving and printing. This layer package for instance comprises a metallic support layer, a copper engraving layer and suitably a protection layer. Deposition of the zinc layer may be tuned for thickness variation, in combination with deposition of the layer package in a fixed thickness.

12 Claims, 1 Drawing Sheet

Figure 1 - PRIOR ART
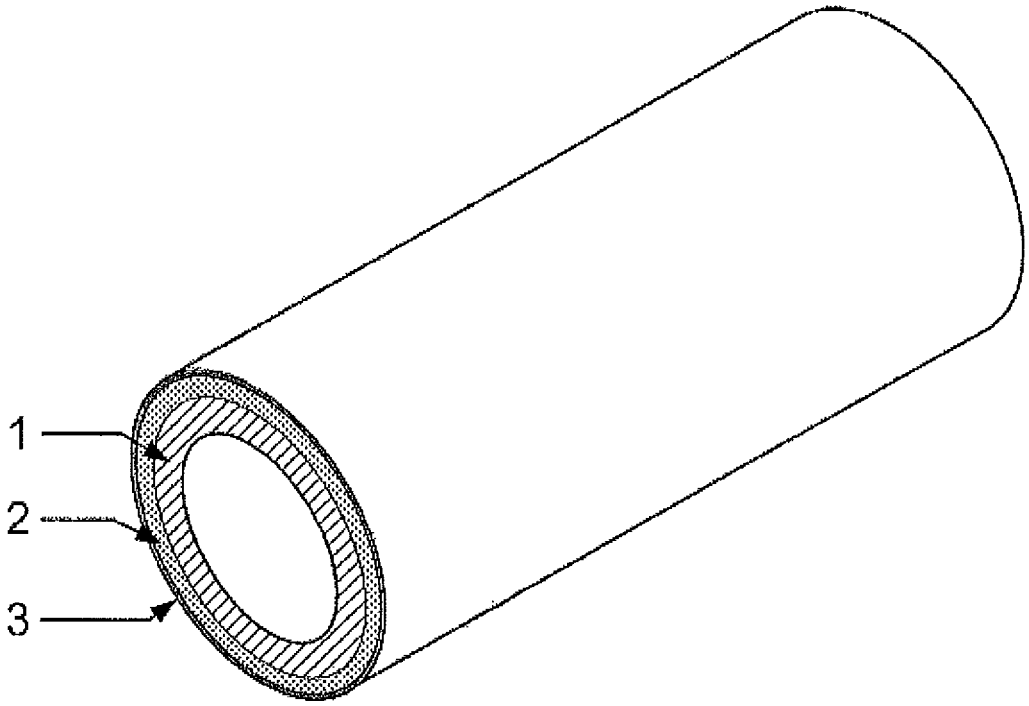
Figure 2 - PRIOR ART
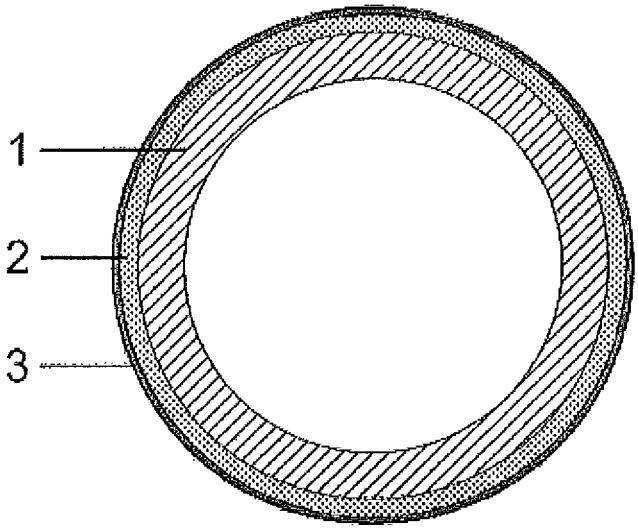

METHOD OF REFURBISHING ROTOGRAVURE CYLINDERS, ROTOGRAVURE CYLINDERS AND THEIR USE

FIELD OF THE INVENTION

The present invention refers to a method for refurbishing rotogravure or gravure cylinders.

The invention also relates to the thus obtained rotogravure cylinders.

The invention further relates to the use of the rotogravure cylinders in the printing industry for the printing of packaging materials (by transfer of ink from the printing cylinder to the packaging material), such as for instance Intaglio printing processes.

BACKGROUND OF THE INVENTION

Rotogravure cylinders (see FIG. 1 which shows such a cylinder, and FIG. 2 which shows a typical cross section of such a cylinder) comprise of the base 1, which is usually made of steel or aluminium with a diameter as required by the printing machine, an image carrying copper layer 2 usually of 0.1 to 1 mm thick where the packaging pattern is engraved upon, and a chrome layer 3 usually 6 to 8 μm thick to increase resistance of the cylinder to wear during the printing process. In FIG. 1 the dimensions shown are not in scale and are shown for descriptive purposes.

A rotogravure life cycle starts with the copper plating, engraving with the required packaging pattern and chrome plating of the cylinder before it is used in the printing machine. The cylinder life cycle continuous at the printing machine with the printing of packaging material. Finally, the cylinder life cycle ends when the industry using the particular cyclinder decides to modify of change the packaging pattern.

US 2011/0083570 describes a process for refurbishing cylinder rollers for use in printing machines wherein an intermediate polymer material layer is placed between the core surface and the image carrying layer of the cylinder, having a conductivity to permit electroplating. The disadvantage of the disclosed process is that an intermediate polymer layer is used for the construction of a refurbished rotogravure cylinder. The disclosed intermediate polymer layer is a soft material which leads to a limited life time in printing processes due to the constantly applied forces onto the rotogravure cylinder. Further, the process is problematic with regard to the diameter stability. More specifically, shrink tape is necessary to ensure an intermediate polymer layer having a stable diameter.

Accordingly, there is a need in the art for a simple and effective process for the refurbishment of user rotogravure cylinders, which provides rotogravure cylinders having a stable diameter and high wear resistance.

A further problem in relation to the prior art method is that the refurbishment does not result in cylinder having use-properties that are substantially the same as those of new cylinders. Particularly, cylinders are engraved with a engraving pattern and are thereafter used in printing processes with predefined use settings, such as at a predefined rotation speed, with a certain amount and type of ink and at a specific pressure. Preferably, the use settings are the same for all cylinders, or at least for a plurality of cylinders. Hence, the use-properties of refurbished cylinders, such as the hardness, are preferably at least substantially the same as those of new cylinders, so that the use settings can remain the same, and the risk of malfunctioning in printing due to variation of use-settings is minimized.

SUMMARY OF THE INVENTION

It is therefore an object to overcome the drawbacks from the prior art and to provide a refurbishing method of a rotogravure cylinder in order to provide reuse of the rotary gravure base.

It is a further object to provide refurbished, or recycled, rotogravure cylinders and the use thereof in the printing industry, wherein the rotogravure cylinders are refurbished in a manner that their use properties will be at least substantially the same as those of new cylinders.

According to a first aspect of the present invention, a method of refurbishing a rotogravure cylinder comprising a rotary gravure base and thereon a copper engraving layer, which method comprises the steps of:

(i) providing the rotogravure cylinder to be refurbished;

(ii) removing the copper engraving layer, therewith obtaining the exposed rotary gravure base;

(iii) applying a zinc layer to the exposed rotary gravure base;

(iv) depositing a metallic support layer to the zinc layer; and (v) electroplating a new copper engraving layer on the metallic support layer thereby providing a refurbished rotogravure cylinder.

Surprisingly, the present inventors found that, by using the present method comprising the zinc layer, rotogravure cylinders can be refurbished in a manner that their use properties are at least substantially the same as those of new cylinders. The application of the zinc layer provides advantageous properties such as a good adhesion to the underlying gravure base, for instance of steel or aluminum. Moreover, the zinc layer turns out applicable in any desired thickness up to several millimeters, so that the diameter of the refurbished cylinder may be tuned. At the same time, the layer package on top of the zinc layer may be provided in the substantially the same thickness as such layer package in new cylinders, so that the use-properties will be the same. Beneficial to this use-properties is furthermore the excellent adhesion of the zinc layer with a metallic support layer thereon. A further advantage of the zinc layer is that there is no risk of cracking during engraving or later use. Further, the method of the present invention is cost effective and environmental friendly, since used rotogravure cylinders of any size can be refurbished virtually without quality loss in comparison to new rotogravure cylinders.

According to a second aspect of the present invention, a refurbished rotogravure cylinder is provided, which is obtainable by the present method of refurbishing rotogravure cylinders.

According to a third aspect, the present invention relates to an intermediate product comprising a cylindrical rotary gravure base onto which a circumferential zinc layer extends, the base and the circumferential zinc layer having a mutual interface, on which circumferential zinc layer a support layer and thereon an electroplated copper engraving layer are present.

According to a fourth aspect the present invention relates to a rotogravure cylinder comprising a cylindrical rotary gravure base onto which a circumferential zinc layer extends, the base and the circumferential zinc layer having a mutual interface, on which circumferential zinc layer are present a support layer, an electroplated copper engraving layer that is engraved with a desired pattern, and an outer chrome-containing protection layer.

In a preferred embodiment, the obtained refurbished rotogravure cylinder is advantageously engraved according to a desired pattern and/or protected by a new protection layer, preferably comprises a chrome layer. In this way, a recycled rotogravure base could be re-used for a new printing application due to the new engraved pattern.

According to a fifth aspect of the present invention, is provided the use of the present rotogravure cylinder, especially use for the printing of packaging materials by transfer of ink from the rotogravure cylinder to the packaging material.

It was found in investigations leading to the invention that by the present simple method a refurbished rotogravure cylinder could be obtained, which can be used in existing printing applications. Surprisingly, the present zinc layer provides a stable diameter which diameter remains equal during a second life time of the rotogravure cylinder base, which second life time is equal to the first life time of the rotogravure cylinder base.

Particularly, it was found that the overall cylinder diameter is tunable by means of the thickness of the zinc layer. An existing cylinder may thus be refurbished to obtain a refurbished cylinder with a different diameter. This provides clients with enhanced flexibility, so as to print packages of varying sizes, for which cylinders with different diameters are required. The diameter may be set in accordance with the process of the invention with an accuracy of 2 mm, 1 mm, 0.5 mm, 0.3 mm or even significantly better. The advantage of varying the thickness of the zinc layer rather than any subsequent layer is that the properties of the engraving layer are not subject to change, i.e. the properties of the resulting cylinder, such as thermal expansion, ink absorption, hardness, will be most uniform notwithstanding a diameter variation In one preferred embodiment, the thickness of the zinc layer is tuned so as to arrive at a diameter that is a predefined amount less than the final diameter. This predefined amount is for instance in the order of 200-350 μm, such as 250-300 μm.

The advantage of zinc over alternative materials is believed to be due to its softness, which allows conformal deposition onto the underlying gravure base, rather independent of the material at the surface thereof. Suitably, the zinc layer has a Vickers hardness of at most 300 HV, more suitably at most 200 HV, or even at most 150 HV.

The zinc layer is suitably provided as a plurality of sublayers. Such sublayers suitably have a thickness of less than 0.5 mm, for instance less than 0.3 mm or even less than 0.1 mm. The sublayers are for instance applied in a spraying process, though alternative deposition processes are not excluded.

The overall thickness of the applied zinc layer is suitably in the order of millimeters, for instance between 0.5 and 10 mm, for instance 1-6 mm. However, other thicknesses are not excluded.

In order to obtain a desired cylindrical shape, with typically a substantially circular cross-section, a shaping step is suitably done after the deposition of the zinc layer. Such a shaping step may be carried out with any conventional tool, for instance by cutting with a cutting tool or treatment with a laser, such as laser cutting.

Further, the present zinc layer provides excellent adhesion to the present copper support layer. In a most suitable embodiment, the provision of the copper support layer is carried out to form a brass layer at the interface of the zinc layer and the copper support layer. Thereto, the copper support layer may be deposited by means of electrodeposition or such that melting occurs at the surface of the cylinder, i.e. the interface with the zinc layer. Brass is known to have a low brittleness at ambient temperature. Also, in these use conditions, the interdiffusion of copper and zinc is not an issue.

Suitably, the present zinc layer is a zinc alloy. More preferably the present zinc layer comprises nickel, aluminium, copper and/or magnesium. One advantage of such alloy is a higher stability against interdiffusion of zinc and copper, particularly when applying the—copper—support layer by means of electroplating. The alloying elements are suitably present in low quantities, for instance less than 10 wt %, preferably less than 5 wt %, or even less than 3 wt %, or even 0.02-2 wt %. More particularly, aluminum or nickel are suitably present as primary alloying element, and magnesium and/or copper may be present in smaller quantities, for instance 0.1 to 0.8 wt % copper and less than 0.05 wt % magnesium. An upper limit to the content of the alloying element(s) results from an increase in hardness with an increase in alloying element.

It is an advantage of the present invention that the refurbishing process of rotogravure cylinder is simplified. Particularly, the step of applying an intermediate polymer layer could be eliminated in comparison with the method of US 2011/0083570, thereby preventing problems with the diameter stability during a second life time of the rotogravure cylinder base.

Preferably, the present step (i) of providing the rotogravure cylinder comprises the provision of a used rotogravure cylinder. Preferably, the base of the present rotogravure cylinders comprises steel and/or aluminium. Advantageously, the present method can be used to refurbish nearly all type of rotogravure cylinders and thus is broadly applicable.

In a preferred embodiment, the present metallic support layer, particularly a copper support layer, is applied by melting of deposited particles. In this manner, a continuous copper support layer was obtained, which moreover included to compressive stress.

The copper support layer is more preferably obtained by deposition of copper particles in a spraying process. More preferably a high velocity spraying process is used. In such a process, the particles are applied with a high speed such as at least 300 m/s onto the cylinder. Suitably, the cylinder herein rotates during the deposition process. The particles will impact on the cylindrical base, which results in liberation of a significant amount of energy in the form of heat. This heat will warm up the particles so as to melt at least partially.

Alternatively, use is made of a sequence of a preplating step and a plating step for the deposition of the support layer, wherein the preplating step is carried out in alkaline conditions, and the plating step is carried out in acid conditions. The materials deposited in the preplating step and the plating step do not need to be identical. For instance, the preplating step may result in a copper alloy, for instance copper-nickel, whereas the plating step may result in substantially pure copper.

It is an advantage of the invention that the present metallic support layer, which is preferably a copper support layer, and the copper engraving layer may be thin, preferably less than 150 μm each. More suitably, the support layer has a thickness of between 100 and 150 μm, for instance around 125 μm. This is made possible in that the formed metallic support layer has a very low porosity, suitably less than 1.0%, preferably less than 0.5% or even less than 0.2%. This is in contrast to the prior art support layer of WO2011/073695A2, relating to the manufacturing of rotogravure cylinders with an aluminum base.

Most suitably, the present copper support layer is after formation even thinned back. This thinning is for instance carried out by sawing. A lubricant solution may be applied simultaneously with the cooling. This process furthermore results in a suitable polishing of the surface of the metallic support layer. The polished copper support layer is then suitable for the electroplating of the copper engraving layer. In one suitable embodiment, around 50 μm of the support layer may be removed. It will be apparent, that in order to arrive at a required thickness, the initially deposited thickness may be larger than desired, for instance in the range of 150-200 μm.

After deposition of the engraving layer a protection layer is suitably applied. Typically applied protection layers comprise chrome, preferably in a thickness of 6 to 10 μm. The protection layer is thereafter suitably roughened to a surface roughness between 0.03 and 0.07 μm.

BRIEF INTRODUCTION OF THE FIGURES

These and other aspects of the invention will be further elucidated with respect to the following figures, wherein:

FIG. 1 shows a diagrammatical bird's eye view of a rotogravure cylinder;

FIG. 2 shows a diagrammatical cross-sectional view of the rotogravure cylinder

ILLUSTRATED DISCUSSION OF DETAILED EMBODIMENTS

The FIGS. 1 and 2 are not drawn to scale and they are only intended for illustrative purposes. Equal reference numerals in different figures refer to identical or corresponding figures.

The term 'rotogravure cylinders' relates herein to rotogravure cylinders and/or any gravure cylinders used in the printing industry, particularly for the printing of packaging materials. The length of such cylinders is typically at least 1.0 meter, more preferably in the order of 1.5-2.5 meter.

The term 'cylindrical base' as used in the context of the present invention does not require the base to be a block-like material. Rather the base may be hollow. Alternatively, the base may comprise several layers, such as a steel core and an aluminium top layer.

The term aluminum in the present invention refers to pure aluminum, aluminum with small addition of other materials or aluminum alloys. Likewise, the term copper refers to pure copper, copper with small addition of other materials or copper alloys. Most suitably, however, in the process in accordance with a preferred embodiment of the invention, particles are sprayed that contain at least 99% copper, more preferably at least 99.5% copper or more. Likewise, the term 'zinc layer' comprises a zinc layer and a zinc alloy.

The term high velocity spraying relates to a spraying process wherein particles are sprayed with a velocity of at least 300 m/s, more preferably at least 500 m/s, at least 800 m/s or even at least 1,000 m/s. Preferably, use is made of a jet with a velocity above the said particle velocity. Generation of a supersonic jet is considered most advantageous. Herein, the jet velocity may be higher than 1,400 m/s.

High velocity spraying may for instance be implemented with High-Velocity Air Fuel (HVAF) technology and guns as commercially available from UniqueCoat Technologies, LLC from Oilville, Va. 23129, USA.

In a preferred embodiment, the present applying of a zinc layer to the exposed rotary gravure base comprises thermal wire spraying of the exposed rotary gravure base with zinc, or a zinc containing layer such as a zinc alloy, preferably comprising thermal wire spraying of multiple layers.

In a preferred embodiment, the present applying of a zinc layer to the exposed rotary gravure base comprises applying a zinc layer to achieve a cylinder having a diameter, which is smaller than a final diameter according to a predefined difference. The difference is for instance in the range of 200-400 μm, or between 250-350 μm, such as 300 μm. The relevance hereof is that the properties of the resulting cylinder, relevant for engraving and use, can be the same, even though the final diameter varies. A final diameter is defined as the desired diameter of the provided refurbished rotogravure cylinder.

The term 'at least partial melting' refers to a process wherein at least the surface of individual particles is melted so as to create a homogeneous layer. It is not excluded that inner cores of the said particles remain in solid form. It is moreover not excluded that the copper support layer created by melting of copper particles is actually an alloy with some zinc of the underlying zinc layer. Such an alloy may well be created, particularly close to the interface with the zinc layer. The composition of the copper support layer further away from the zinc layer may thus be different from the composition near to said interface.

In the preferred embodiment wherein the copper particles are sprayed onto the present zinc layer in a high velocity process, it is foreseen that the impact of the copper particles onto the zinc layer may result in deformation and fracture of the top layer of the zinc layer. Such deformation is deemed beneficial so as to obtain a larger interface area and/or some mechanical anchoring of the copper into the zinc.

The subsequent melting and furthermore the thinning step are highly suitable in combination therewith, so as to ensure appropriate dimensions and particularly appropriate roundness when seen in cross-sectional view perpendicular to an axial direction of the cylindrical base.

Preferably, a high velocity spraying process is used for the present spraying of copper particles. Use may be made of a gun as available from UniqueCoat Technologies, LLC, as sold as M3. The copper particles, with an average diameter of less than 50 μm, preferably in the range of 40-45 μm, were sprayed with a jet velocity of 1,200-1,400 m/s, resulting in a particle velocity of 900-1000 m/s. During the spraying process, the cylinder was rotated. Impact of the substantially pure copper particles onto the cylinder resulted in deformations in the cylinder, and in heating up of the particles, to the extent of at least partial melting. This melting resulted in formation of a single support layer extending circumferential around the base. Compressive stress developed in the course of cooling down. This cooling down was achieved by waiting in one embodiment; in an alternative embodiment, jetted air was sprayed onto the cylinder with the support layer. For the jet spraying, the same gun as mentioned above was used, but this is not considered essential.

Alternatively, the present metallic support layer, preferably a copper support layer, is applied in a process comprising a preplating step and a subsequent plating step. Suitably, the preplating step is carried out in an alkaline bath, whereas the plating step is carried out in an acid bath. In one specific implementation, the preplating step comprises plating a copper layer of for instance 5 to 10 μm to the zinc layer by using an alkaline copper or nickel copper solution, suitably having a pH within the range of 8 to 10.

Preferably, during the present preplating, the cylinder is revolving with a speed of 100-150 rpm, the current density preferably ranges between 1 and 2 amps/dm$^2$ and/or the plating time is preferably approximately 30 minutes at a temperature up to 55° C., more preferably from 40° C.-55° C.

In a further specific implementation, the plating step comprises electroplating the cylinder by using a solution comprising copper sulfate and sulfuric acid to apply a copper layer of 100 to 300 μm thick. The solution suitably has a temperature within the range of 30 to 40° C. A typical concentration is 190-230 gr $CuSO_4 \times 5H_2O$ per liter of solution.

Preferably, the solution also comprises a hardness additive to provide a copper support layer having a hardness up to 220 to 230 HV. It is advantageous when during the electroplating the cylinder is revolved with a speed of 100 to 150 rpm. Preferably, the electroplating current density is within the range of 20 to 40 amps/dm$^2$ and electroplating time is 50 to 150 minutes.

In one embodiment, the resulting metallic support layer had a thickness of approximately 125 μm. This layer was thereafter thinned and polished, by means of a sawing process. Use was made of a diamond saw, as known for the sawing of copper or copper-containing elements. A lubricant was sprayed while sawing so as to prevent too much heating of the metallic support layer. Moreover, herewith a polishing was achieved as well. The sawing resulted in removal of about 50 μm thickness of copper. The copper support layer was therewith ready. It is however not excluded that additional layers are deposited.

In an alternative embodiment, the deposited metallic support layer had a thickness of 40-80 microns, for instance about 50 microns. This layer was thereafter thinned, for instance with 40-60%. Use was made herein of grinding with a conventional grinding machine with grinding and polishing stones.

In a subsequent step, a copper engraving layer with a high hardness, suitably in the range of 200-240 HV, was deposited. The layer was deposited in a thickness of 60-200 μm, for instance 150 μm. In one embodiment, a layer thickness was chosen that was substantially corresponding to the layer thickness of the copper support. However, thicker layers are not excluded. The deposition process for such an engraving layer is known per se and involves electroplating. Use was made in one embodiment of a solution of copper sulfate (200-230 gr $CuSO_4 \times 5H_2O$) and sulfuric acid (60-65 gr $H_2SO_4$ per liter of solution) and a catalyst for hardness. The catalyst does not have any particular properties and can be found easily in the market. During the plating, the cylinder is revolved with a speed of about 100 rpm. The current density during electroplating in this phase ranges from 20 to 25 amps/dm$^2$ for about 80-100 min and with a solution temperature maintained at about 30° C. Further details in relation to this process are known from various patents, such as U.S. Pat. No. 4,334,966, U.S. Pat. Nos. 4,781,801, 5,417,841 and 7,153,408, which are herein included by reference.

Thereafter, the present refurbished rotogravure cylinder was preferably polished to achieve desired surface roughness (usually $R_z$ is between 0.03 μm and 0.07 μm). A protection layer and engraving may thereafter be applied, as known to the skilled person.

In an alternative embodiment, which was tested particularly in combination with a ground and thin copper support layer as discussed above, the copper engraving layer was formed by deposition and subsequent thinning and polishing. Here again, a thinning to approximately half of the deposited thickness turned out suitable in practice. However, it is not excluded that the thinning removes merely 20-40% of the deposited thickness.

In summary, the rotogravure cylinder of the invention comprises a rotary gravure base and thereon a copper engraving layer is refurbished to contain a zinc layer between a gravure base and a layer package suitable for engraving and printing. This layer package for instance comprises a metallic support layer, a copper engraving layer and suitably a protection layer. Deposition of the zinc layer may be tuned for thickness variation, in combination with deposition of the layer package in a fixed thickness.

The invention claimed is:

1. Method of refurbishing a rotogravure cylinder comprising a rotary gravure base and thereon a copper engraving layer, which method comprises the steps of:

(i) providing the rotogravure cylinder to be refurbished;

(ii) removing the copper engraving layer, therewith obtaining the exposed rotary gravure base;

(iii) applying a zinc layer to the exposed rotary gravure base, wherein the zinc layer comprises zinc or a zinc alloy; and (iv) applying a layer package suitable for engraving and printing, comprising a metallic support layer that contains copper and a new copper engraving layer, wherein the metallic support layer is applied by at least partial melting of deposited copper particles.

2. The method as claimed in claim 1, wherein the exposed rotary gravure base is roughened prior to the application of the zinc layer.

3. The method as claimed in claim 2, wherein the roughening occurs in a single process step jointly with the removal of the copper engraving layer.

4. The method as claimed in claim 1, wherein the removal occurs by sandblasting.

5. The method as claimed in claim 1, wherein the zinc layer is deposited in multiple sublayers.

6. The method as claimed in claim 1, further comprising the step of engraving of the new copper engraving layer according to a desired pattern.

7. The method as claimed in claim 6, further comprising: protecting the engraved new copper engraving layer with a new protection layer.

8. The method as claimed in claim 1, wherein step (iii) comprises applying a zinc layer to achieve a cylinder having diameter which is around 300 μm smaller than a final diameter.

9. The method as claimed in claim 1, wherein the step of applying the layer package comprises:

depositing a metallic support layer to the zinc layer; and electroplating a new copper engraving layer on the metallic support layer thereby providing a refurbished rotogravure cylinder.

10. The method as claimed in claim 1, wherein the copper engraving layer is formed by deposition and subsequent thinning and polishing.

11. The method as claimed in claim 1, wherein the copper of the copper engraving layer is chosen from pure copper, copper with small additions of other materials and copper alloys.

12. The method as claimed in claim 1, wherein the zinc layer contains a zinc alloy with at least one of nickel, aluminum, copper and magnesium.

* * * * *